United States Patent [19]

Jost

[11] 4,334,594

[45] Jun. 15, 1982

[54] AERIAL DEVICE

[75] Inventor: Richard P. Jost, St. Louis, Mo.

[73] Assignee: McCabe Powers Body Company, St. Louis, Mo.

[21] Appl. No.: 79,456

[22] Filed: Sep. 27, 1979

Related U.S. Application Data

[63] Continuation-in-part of Ser. No. 969,169, Dec. 13, 1978, abandoned.

[51] Int. Cl.[3] ..... B66F 11/04

[52] U.S. Cl. ..... 182/2

[58] Field of Search ..... 182/2, 141, 222, 152

[56] References Cited

U.S. PATENT DOCUMENTS

| | | | |
|---|---|---|---|
| 3,196,979 | 7/1965 | Garnett | 182/2 |
| 3,204,720 | 9/1965 | Eitel | 182/2 |
| 3,295,633 | 1/1967 | Milner | 182/2 |
| 3,452,528 | 7/1969 | Fairchild | 182/2 |
| 3,596,976 | 8/1971 | Eitel | 182/2 |
| 3,826,334 | 7/1974 | Spillman | 182/2 |

*Primary Examiner*—Reinaldo P. Machado

*Attorney, Agent, or Firm*—John D. Pope, III

[57] ABSTRACT

An articulated aerial device is provided which includes a workman's basket suspended from a movable beam. The basket is attached to the movable beam by an attaching means which selectively permits the basket to rotate for permitting easy access to an injured workman therein.

4 Claims, 5 Drawing Figures

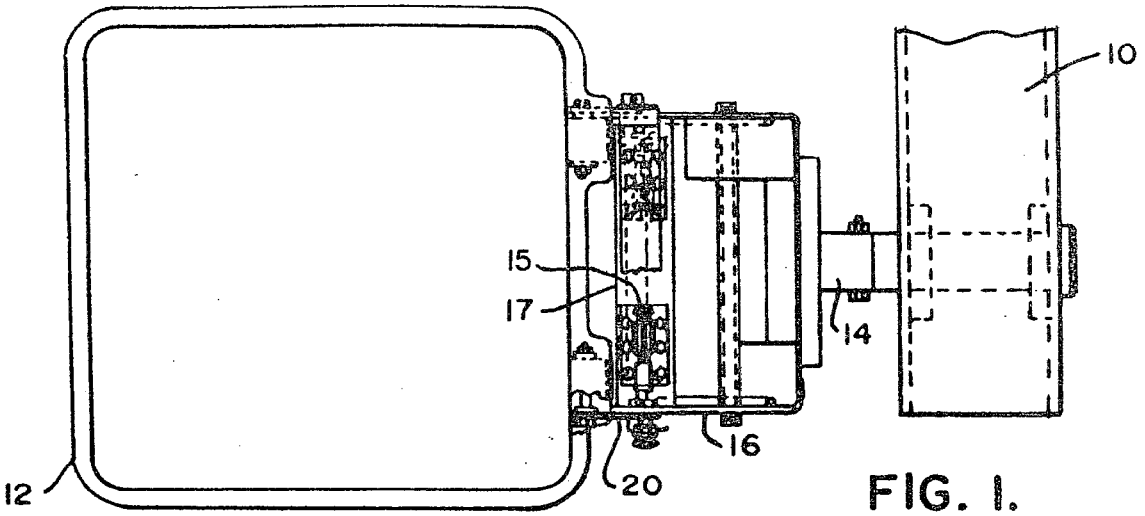
FIG. 1.
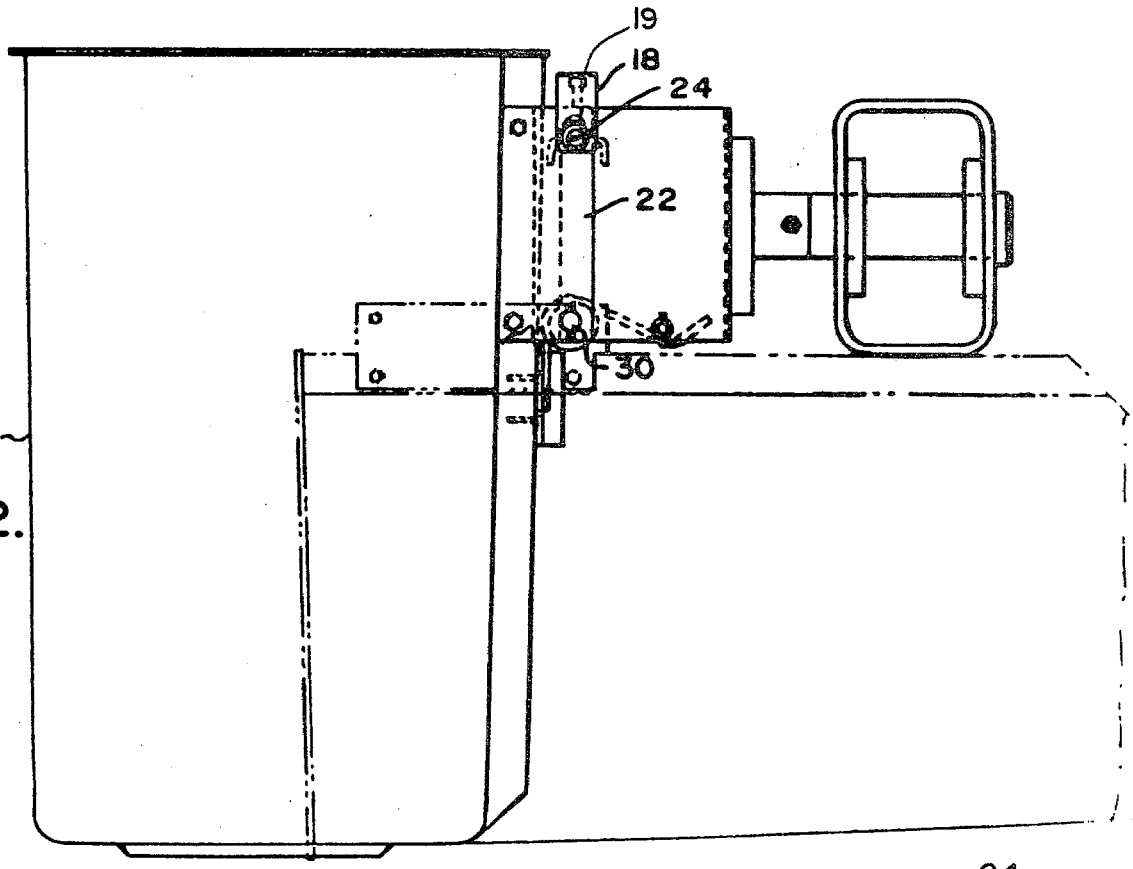
FIG.2.
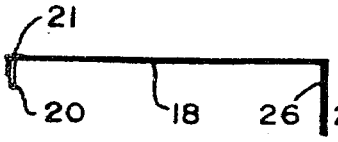
FIG.3.
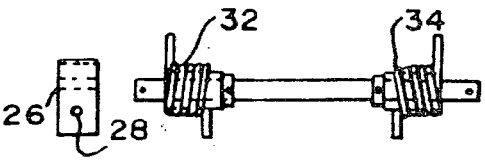
FIG. 4.
FIG.3A.
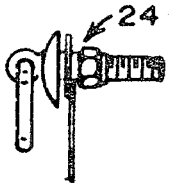
FIG.5.

AERIAL DEVICE

This is a continuation-in-part application of copending application Ser. No. 969,169 filed Dec. 13, 1978 and now abandoned.

This application relates to articulated aerial devices and more particularly to such devices which include a workman's basket attached to a movable beam.

Articulated aerial devices of many types have been provided and a substantial number of these include a basket designed to support a workman at an elevated location permitting him to carry out designated tasks at a substantial distance above ground. Although highly effective for such purposes these devices provide a difficult environment in an emergency situation when the workman in the basket is injured and where it becomes necessary to remove him from the basket without his cooperation. For this reason safety precautions often require the presence of three man crews where only one of these is to be located in the basket at an elevated spot.

Among the objects of the present invention are the provision of an aerial device which includes a workman's basket constructed so that the basket can be lowered to the ground by controls remote from the basket and it can then be maneuvered so that the basket is placed on its side to facilitate removal of an injured and helpless workman. Other objects and features will be in part apparent and in part pointed out hereinafter.

The invention accordingly comprises the constructions hereinafter described, the scope of the invention being indicated in the following claims.

In the accompanying drawings in which one of various possible embodiments of the invention is illustrated, FIG. 1 is a top plan of the basket suspension of an aerial device incorporating the mechanism of the present invention;

FIG. 2 is a side elevation of the basket in its attached position;

FIG. 3 is an elevation of the latch which removably holds the basket in its FIG. 2 position;

FIG. 4 is an enlarged view of the pivot shaft on which the basket can pivot when the latch is disconnected; and FIG. 5 is an enlarged view of the safety bolt which when removed releases the basket for pivoting.

Corresponding reference characters indicate corresponding parts throughout the several views of the drawings.

The aerial device of the present invention includes the customary movable beams terminating in an outer beam 10 from which basket 12 is supported by the customary suspending shaft 14 and support 16. In the usual manner basket 12 is supported by support 16 so that under normal operating conditions it is free to rotate with respect to beam 10 in response to the force of gravity.

Support 16 includes a channel 17 which supports clamps 15 (See FIG. 1) preferably of the type having handles which clamp when the handles are down and release when the handles are up, for clamping the top of side brackets 22 to the support 16. Latch 18 has turned down extensions at each end (See FIG. 3). The short turned down extension is attached to latch member 18 by hinge 21 and is welded at its end to the top 20 of one of the side brackets 22 which is bolted to basket 12. The other end of latch 18 has a long turned down extension

26 which, when the latch 18 is in its closed position, extends over the other one of side brackets 22. Extension 26 has a hole 28 which, when latch 18 is in the latched closed position, comes into register with a hole in the corresponding one of side brackets 22 such that removable bolt 24 may be inserted to bolt the latch 18 in the latched closed position.

Basket 12 is supported for pivotal movement on pivot shaft 30 (See FIG. 4). Shaft 30 is journaled in side brackets 22 and is biased by torsion springs 32 and 34 to retain basket 12 in its upright position as shown in FIG. 2 but the tension of these springs is adjusted so that their bias can be overcome by the normal weight of a workman.

The clamps for clamping side brackets 22 to support 16 have handles 19 (See FIG. 2) which when moved to the down position lock the tops of brackets 22 to support 16. Latch 18 is then moved to the closed position shown in FIG. 2 and secured by bolt 24. The latch member 18, when in the closed position, insures that the clamp handles remain in the down position insuring that the clamps lock the tops of brackets 22 to support 16.

In the customary manner the operation of the aerial device is controlled by either of two sets of controls, one in the workman's basket and the other adjacent to the main mast. The main mast is customarily located on a truck body or other movable carriage with the movable beams terminating in outer beam 10 extending therefrom. In this way the position of the beams can be altered either by a workman in the basket or by a workman on the ground adjacent the vehicle on which the device is mounted.

If the workman in the basket is injured the workman on the ground using the controls adjacent the main mast can lower the beam from which the basket is suspended until the basket bottom rests on the ground. Bolt 24 is now unscrewed thereby releasing the latch member 18 from one of the brackets 22 and latch member 18 rotated on hinge 21, giving access to the clamps on channel 17. When the handles of the clamps are pulled up, the tops of side brackets 22 are released from support 16, and basket 12 is supported only from pivot shaft 30. If the beam 10 is then raised sufficiently to permit the basket to rotate this will occur until it has pivoted approximately 45° under the weight of the injured workman with the center of gravity of the basket under the pivot point. If beam 10 is now lowered the basket will fold completely under the beam so that the basket assumes a horizontal position and side 36 is resting on the ground. At this point the workman on the ground can remove the injured workman without being forced to lift him up out of the basket but can drag him from it and initiate whatever rescue operations are needed by the injured workman. After the injured workman has been removed from basket 12, beam 10 can be slowly elevated and as this occurs basket 12 will pivot back approximately 45° under the stress of torsion springs 32 and 34 until the basket is in the FIG. 2 position.

The clamps on channel 17 can now be reset locking the tops of side brackets 22 to support 16, latch 18 rotated back to the closed position and safety bolt 24 replaced, making the device ready for further operation in the usual manner.

After the injured workman has been removed caution should be exercised in elevating the basket from the horizontal position since torsion springs 32 and 34 cause the empty basket to flip up quickly to a vertical position.

In view of the foregoing it will be clear that the aerial device of the present invention can be safely operated by a two man crew. If the workman in the basket at any time becomes injured he can be easily removed from the basket by the other workman because of the basket construction and removed to another location for first aid or other treatment. The rotation of the bakset caused by the weight of the injured workman and the operation of the aerial device to fold it under the beam permits quick and effective removal of the injured workman by a single colleague.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An articulated aerial device comprising a movable beam, a workman's basket, means attaching the basket to said beam permitting the basket to depend therefrom and pivot about an axis therethrough, biasing means attached to the basket to resist pivoting of the basket around said axis, and releasable locking means for locking said beam and basket together, release of the locking means permitting the basket to be pivoted against the bias of said biasing means, said releasable locking means including releasable clamp means having a locked position locking said beam and said basket together and an unlocked position unlocking said basket from said beam, said locking means also including safety means which in a latched position prevent said clamp means from moving from the locked position to the unlocked position.

2. An aerial device according to claim 1 in which pivoting of the basket brings the center of gravity of the basket under the point of rotation.

3. An aerial device according to claim 1 in which said safety means includes a member attached at one end to said attachment means and hinged for rotating from a latched position to an unlatched position, and having an extension at the other end of said member which when said member is in the latched position, extends over a portion of said attaching means for releasably securing said member into place.

4. An aerial device according to claim 1 in which said releasable clamp means have operating means which have an up position moving said clamp means to the unlocked position, and a down position moving said clamp means to the locked position, and in which said safety means member may not be rotated to the latched position when said operating means of said clamp means are in the up position.

* * * * *